US005313872A

United States Patent [19]

Foster

[11] Patent Number: 5,313,872

[45] Date of Patent: May 24, 1994

[54] END OF STROKE CUSHION FOR A LINEAR HYDRAULIC MOTOR

[76] Inventor: Raymond K. Foster, P.O. Box 1, Madras, Oreg. 97741

[21] Appl. No.: 54,531

[22] Filed: Apr. 28, 1993

[51] Int. Cl.[5] ..... F15B 15/22

[52] U.S. Cl. ..... 91/407; 91/468; 92/85 B

[58] Field of Search ..... 91/405, 406, 407, 408, 91/409, 392, 422, 449, 468; 92/85 B, 111

[56] References Cited

U.S. PATENT DOCUMENTS

| | | | |
|---|---|---|---|
| 845,827 | 3/1907 | Steedman | 91/407 |
| 2,906,248 | 9/1959 | Peras | 91/407 |
| 3,677,141 | 7/1972 | Lagerqvist et al. | 91/407 |
| 4,748,893 | 6/1988 | Foster | 91/176 |
| 5,103,866 | 4/1992 | Foster | 137/596.15 |
| 5,125,502 | 6/1992 | Foster | 198/750 |
| 5,193,661 | 3/1993 | Foster | 198/750 |

FOREIGN PATENT DOCUMENTS

| | | | |
|---|---|---|---|
| 714881 | 8/1965 | Canada | 92/85 B |

OTHER PUBLICATIONS

Hydraulic System Analysis, by George R. Keller; 4th Ed., 1969, by Penton/IPC, Cleveland, Ohio, pp. 130–133.

*Primary Examiner*—Edward K. Look
*Assistant Examiner*—F. Daniel Lopez
*Attorney, Agent, or Firm*—Glenn D. Bellamy; Delbert J. Barnard

[57] ABSTRACT

An end of stroke cushion for a linear hydraulic motor. A piston-cylinder unit includes a cylinder body (42) reciprocally slidable on a piston rod (40) having a piston head (64) which defines working chambers (82, 84) within the cylinder body (42). The piston rod (62) is tubular and includes a plurality of sidewall ports (P1–P7). A radially-expandable annular valve ring (106) normally snugly surrounds the piston rod (62) and during axial movement of the cylinder body (42) relative to the piston rod (62), the valve ring (106) will move axially relative to the sidewall ports (P1–P7) in the piston rod (62). Pressure introduction to the working chamber (84) through the sidewall ports (P1–P7) of the piston rod (62) and against the valve ring (106) radially expands the valve ring (106). This allows oil flow to move into the working chamber (84) such that when the chamber (84) expands, the cylinder body (42) and valve ring (106) will move axially relative to the sidewall ports (P1–P7), successively uncovering the ports (P1–P7) during movement. Removal of fluid from the working chamber (84) will cause oil movement out from the chamber (84), through the sidewall ports (P1–P7) into the tubular piston rod (62) such that when the linear motor (10) approaches the end of its stroke, the valve ring will close the sidewall ports (P1–P7) in the piston rod (62) which allows oil flow out from the working chamber (84) in succession.

3 Claims, 4 Drawing Sheets

END OF STROKE CUSHION FOR A LINEAR HYDRAULIC MOTOR

TECHNICAL FIELD

The present invention relates to linear hydraulic motors. More particularly, it relates to the provision of a linear hydraulic motor which includes a valve mechanism which slows down movement as the drive unit approaches the end of stroke and provides an oil cushion at the end of the stroke so that there is no metal-to-metal contact of the cylinder body component with the piston component which together make up the drive unit.

BACKGROUND ART

A linear hydraulic motor can be damaged if there is contact between the cylinder body and the piston component at the end of a stroke. Even if there is no damage, the metal-to-metal contact can produce a noise which is disturbing to anyone in the vicinity who would hear it. To avoid damage, load alleviation devices are often built into the motors. Examples of these devices, which have been termed buffers, snubbers and dashpots, are disclosed in the text "Hydraulic System Analysis", by George R. Keller, and published by the editors of *Hydraulics & Pneumatics Magazine,* Library of Congress Catalog Card No: 78-52991, on pages 130–133. Of particular interest is the snubbing technique shown by FIG. 9.20 on page 132.

SUMMARY OF THE INVENTION

The present invention provides a novel end of stroke cushion for a linear hydraulic motor. The invention includes a piston-cylinder unit having a cylinder body reciprocally slidable on a piston rod. The piston rod includes a piston head defining a working fluid chamber within the cylinder body. The piston rod is tubular and includes a plurality of sidewall ports. A radially-expandable annular valve ring normally snugly surrounds the piston rod. During axial movement of the cylinder body relative to the piston rod, the valve ring will move axially relative to the sidewall ports in the piston rod. Pressure introduction to the working chamber through the tubular piston rod causes oil to flow through the sidewall ports of the piston rod and against the valve ring. This radially expands the valve ring and allows the oil flow to move into the working chamber such that when the chamber expands, the cylinder body and valve ring will move axially relative to the sidewall ports. This successively uncovers the ports during movement. Removal of fluid from the working chamber will cause oil movement out from the chamber, through the sidewall ports and into the tubular piston rod. When the linear motor approaches the end of its stroke, the valve ring will close the sidewall ports in the piston rod which allow oil flow out from the working chamber in succession.

According to another aspect of the invention, the sidewall ports are positioned such that the last port is closed and further oil flow out from the working chamber is prohibited before there is contact between the piston and a cylinder head portion.

In preferred form, the invention includes a cylinder head positionable into an open end of the cylinder body. This cylinder head includes a central passageway through which the piston rod passes and includes an annular valve ring chamber surrounding the passageway. A center tube may be located within the piston rod to define a fluid passageway through its center which communicates with a first working chamber and an annular second passageway formed by and radially between the piston rod and the center tube for communication with a second working chamber.

Also in preferred form, the valve ring includes an annular split and the valve ring chamber has a radial dimension permitting radial expansion of the valve ring.

According to another aspect of the invention, a cylinder body may be provided with a cylindrical sidewall and an open end. The cylinder body includes a first inside diameter portion and an enlarged inside diameter portion adjacent the open end. A cylinder head which is axially insertable into the open end includes a central passageway through which a piston rod extends. The cylinder head includes a first portion having an outer diameter sized to closely engage the cylinder's first inside diameter and has an axially outwardly-positioned portion having a second larger outer diameter sized to closely engage the cylinder body's enlarged diameter portion. An annular seal is provided which seals between the cylinder head and cylinder body at the cylinder body's first inside diameter portion and the cylinder head's first portion. The overall diameter of the seal ring is less than the inside diameter of the cylinder body's enlarged portion. The cylinder body's enlarged portion includes an inner annular groove for receiving a cylinder head retainer. As the cylinder head, including the annular seal, is inserted into the cylinder body, the annular seal clears and is not damaged by the annular retainer groove.

Other features, aspects and advantages of the present invention will become apparent from a careful reading of the following example of the best mode for carrying out the invention, appended claims and drawings, all of which comprise the disclosure of the present invention.

BRIEF DESCRIPTION OF THE DRAWINGS

Like reference numerals are used to designate like parts throughout the several views of the drawing, and.

BEST MODE FOR CARRYING OUT THE INVENTION

Figure 1:
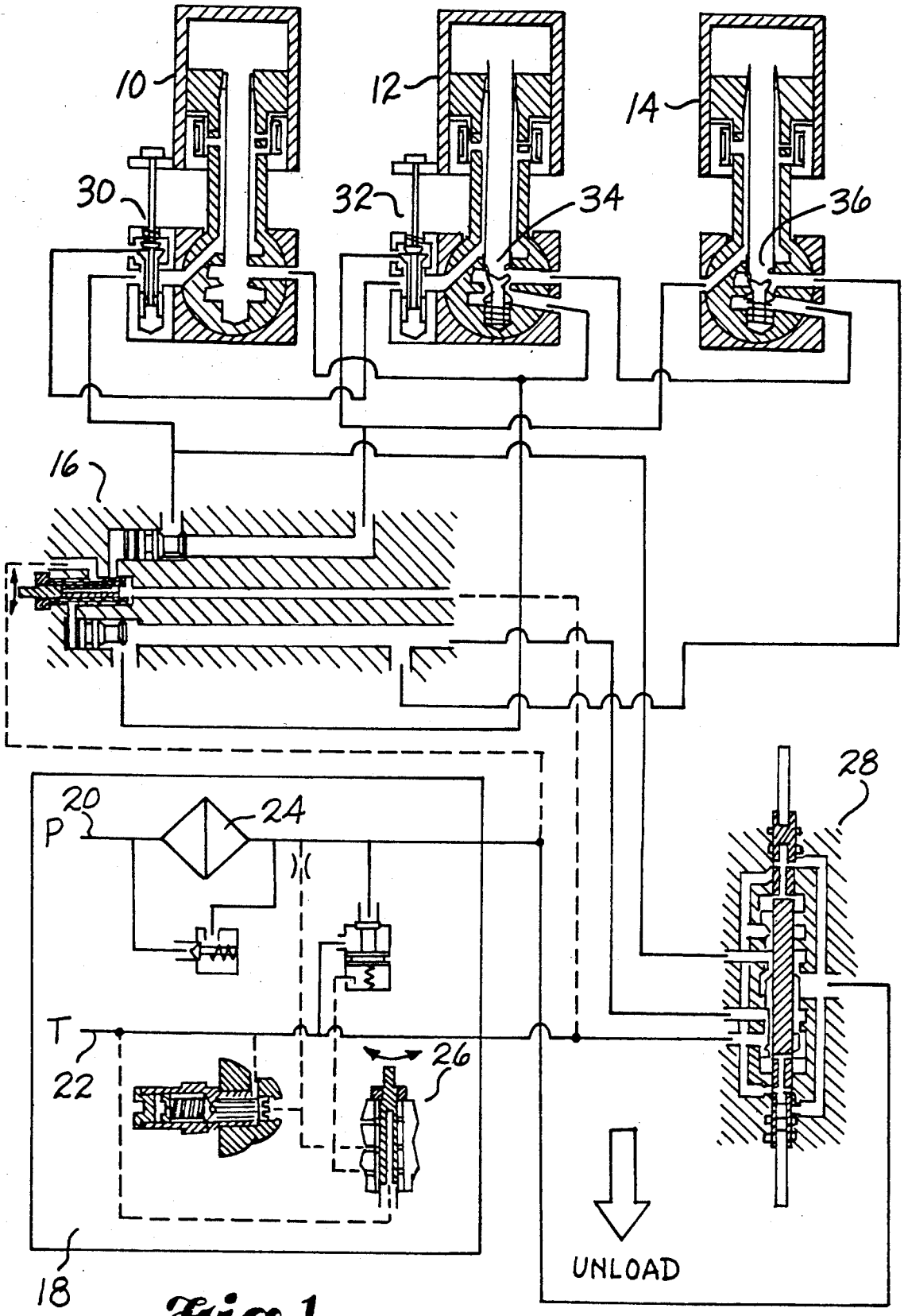
FIG. 1 is a schematic diagram of three linear hydraulic motors and a control system for automatically controlling hydraulic fluid pressure to and from the working chambers of the motors.

FIG. 1 shows a system of linear hydraulic motors that is similar to the system shown in my U.S. Pat. No.

5,193,661, granted Mar. 16, 1993. Like the system disclosed in U.S. Pat. No. 5,193,661, the system of FIG. 1 is designed for controlling the floor slats of a reciprocating floor conveyor. In operation, all three piston-cylinder units (also herein referred to as the "drive units") 10, 12, 14 are retracted in unison to convey a load. Then, they are extended, one at a time, for returning the floor slats to a start position, one third at a time. This sequence is described in my U.S. Pat. No. 5,193,661 and also in my U.S. Pat. No. 5,125,502 granted Jun. 30, 1992, and in my U.S. Pat. No. 4,748,893, granted Jun. 7, 1988.

Referring to FIG. 1, element 16 is a directional control valve. This valve 16 has two positions. In one position, it directs the drive units 10, 12, 14 to unload a load. For example, if the conveyor is in a trailer, the drive units 10, 12, 14 would move the floor slat members in unison towards the rear of the trailer, to unload the cargo in the trailer. When valve 16 is in its second position, it directs drive units 10, 12, 14 to load the trailer. The drive units 10, 12, 14 are moved in unison toward the front end of the trailer, to move the load towards the front end of the trailer. Valve 16 forms the subject matter of my copending application Ser. No. 08/054,534 filed on even date herewith, and entitled "Directional Control Valve."

Assembly 18 includes a port 20 connected to a pump or other source of hydraulic oil pressure and a port 22 connected to return or tank. It preferably also includes a filter 24, an on-off valve 26 and other valving which protects the system from an inadvertent misconnection of port 22 to the pump and port 20 to tank. Assembly 18 forms the subject matter of my copending application Ser. No. 08/054,532, filed on even date herewith, and entitled "Protective Connection to Pressure and Return."

Valve 28 is a switching valve. This valve is disclosed in my U.S. Pat. No. 5,103,866, granted Apr. 14, 1992, and entitled Poppet Valve and Valve Assemblies Utilizing Same Valve 28 is also disclosed and described in my U.S. Pat. No. 5,125,502, granted Jun. 30, 1992, and entitled Drive Mechanism For a Reciprocating Floor Conveyor.

Valves 30, 32 are "pull" type sequencing valves. They function like valves LV4, LV5 and LV6 disclosed in U.S. Pat. No. 5,193,661. Valves 30, 32 are a valve type that is disclosed in my U.S. Pat. No. 5,255,712, granted Oct. 26, 1993, and entitled "Check Valve Pull Assembly."

Drive units 12, 14 also include "push" type sequencing valves 34, 36. Valves 34, 36 are a valve type that forms the subject matter of my copending application Ser. No. 08/054,530, filed on even date herewith, and entitled "Internal Check Valve."

The above-identified patents and applications are hereby incorporated herein by this specific reference.

Figure 2:
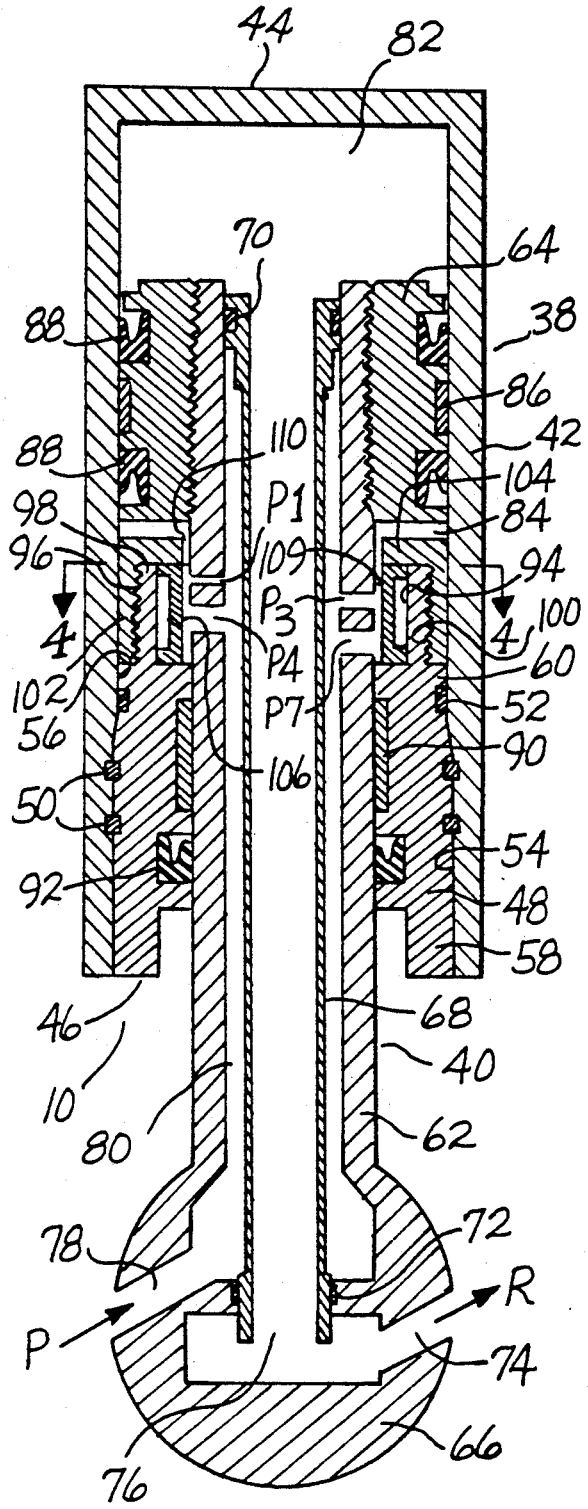
FIG. 2 is a longitudinal sectional view of one of the hydraulic motors, such view showing fluid introduction into a working chamber between the cylinder head and the piston head, and such view showing the fluid pressure expanding the valve rings.
Figure 3:
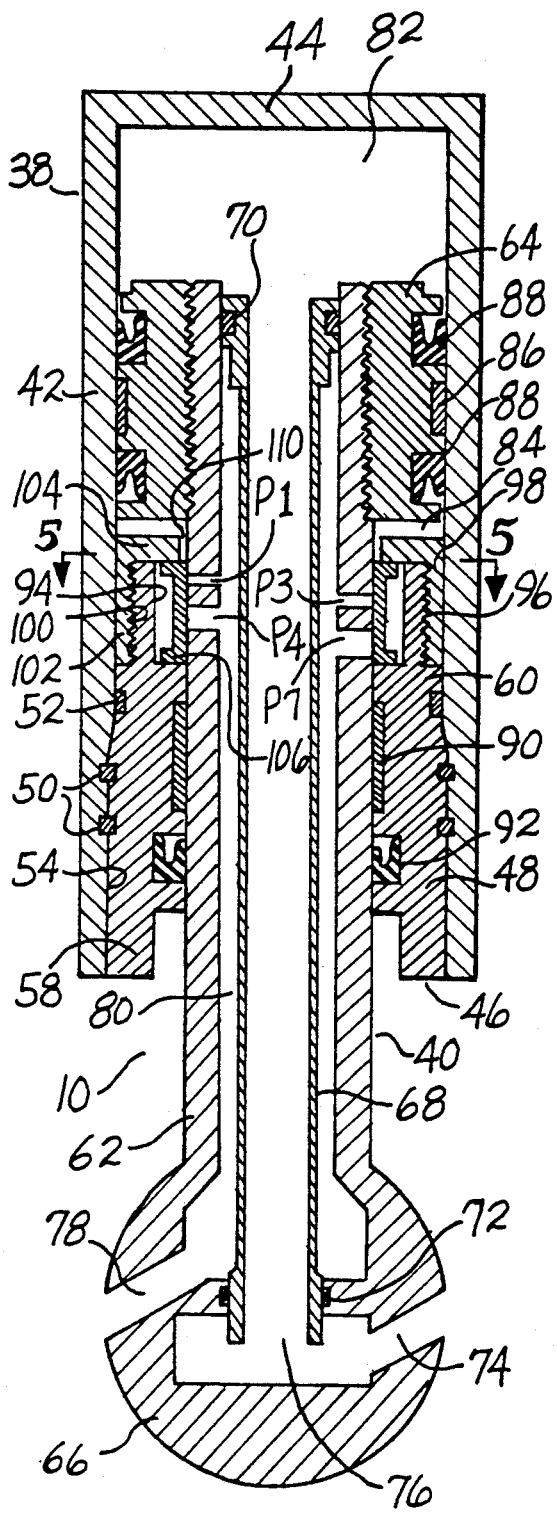
FIG. 3 is a view like FIG. 2, but showing fluid pressure being introduced between the piston head and the end wall of the cylinder body, and showing the piston-cylinder unit near the end of its retraction stroke.
Figure 7:
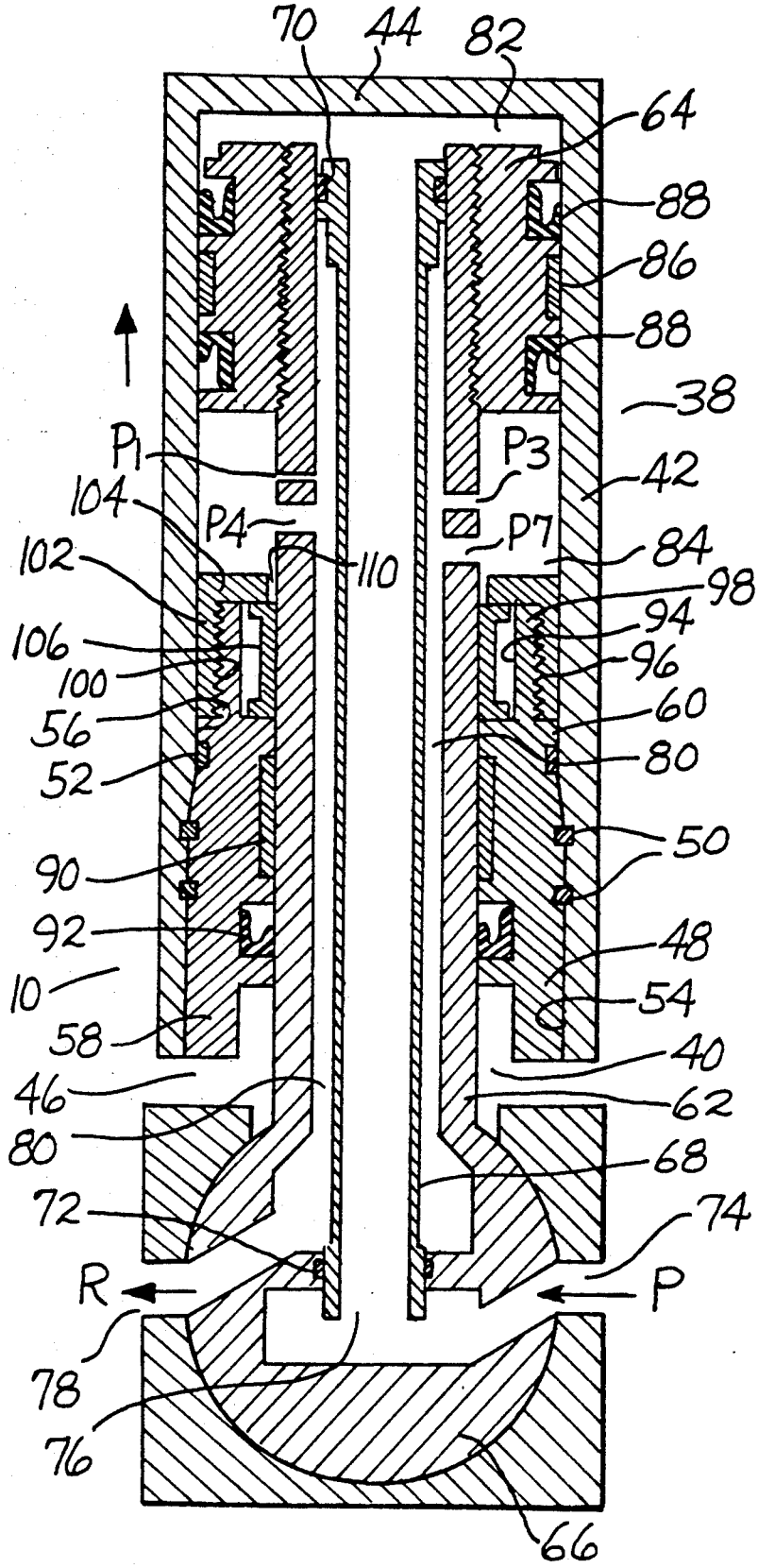
FIG. 7 is a view like FIGS. 2 and 3, at the start of the extension stroke of the piston-cylinder unit.

FIGS. 2, 3 and 7 all relate to drive unit 10. Drive units 12, 14 are essentially like drive unit 10 except that they include the sequencing valves 34, 36.

Referring to FIGS. 2, 3 and 7, drive unit 10 is composed of a cylinder body component 38 and a piston component 40. Cylinder body 38 has a tubular sidewall 42, a closed endwall 44 and an opposite end 46 that is open. A cylinder head 48 fits within the open end of the cylinder body 38. Cylinder head 48 is secured in place by a pair of lock wires 50 which are conventional. Lock wires 50 are located within circumferential grooves formed in an inner portion of wall 42 and an outer portion of cylinder head 48. The two grooves come together to form a passageway that has essentially the same cross sectional shape as the lock wires 50. A tangential opening (not shown) leads into each passageway. A lock wire 50 is fed through this opening into the channels. Each lock wire 50 is moved endwise to in turn move it circumferentially about the drive unit 10 until it is within the passageway forming channels. As illustrated, cylinder head 48 includes a peripheral groove in which a seal ring 52 is situated. In accordance with an aspect of the invention, the end portion 54 of sidewall 42 in the vicinity of the lock wires 50 is larger in diameter than the portion 56 of sidewall 42 in the vicinity of seal ring 52. The portion 58 of cylinder head 48 has a larger diameter than portion 60 of cylinder head 48. Owing to the differences in diameters, the cylinder head 48 can be inserted and removed from the cylinder body 38 without the seal rings 52 being damaged when they move past the grooves in sidewall 42 which form the outer portions of the lock wire passageways. If the diameter of cylinder head 58 in regions 58 and 60 were the same and if the diameters of sidewall 42 in regions 54, 56 were the same, then the outer periphery of the seal ring 42 would be compressed by contact with wall 42 as the cylinder head 48 is being moved into or removed out from cylinder body 38. Seal ring 52 would expand into the lock wire grooves as it moves relatively past the look wire grooves. The sharp boundaries of the lock wire grooves could cut and thus damage the seal ring 52. The different diameters that are illustrated and which have been described allow seal ring 52 to move past the lock wire grooves without damage.

Piston 40 is composed of a tubular piston rod 62 and a piston head 64. A ball 66 is provided at the outer end of piston rod 62. As is known per se, and as shown in FIG. 1, the ball 66 fits within the ball socket that is part of a manifold block. A central tube 68 extends axially through piston rod 62. Tube 68 is sealed at 70 and 72. A first port 74 in ball 66 leads to the outer end 76 of tube 68. A second port 78 in ball 66 leads into an annular passageway 80 that is formed by and radially between piston rod 62 and tube 68. Seals 70, 72 form closures for the opposite ends of passageway 80. Introduction of fluid pressure into port 74 while port 78 is connected to return or tank will cause an extension of the drive unit 10 and an enlargement of working chamber 82. A second working chamber 84 is formed axially between cylinder head 48 and piston head 64. As is well-known in the art, working chambers 82, 84 are variable volume chambers. When chamber 82 gets larger, chamber 84 gets smaller. When chamber 84 gets larger, chamber 82 gets smaller. As is also known per se, the piston head 64 includes a wear ring 86 and a pair of seal rings 88. Cylinder head 48 includes a wear ring 90 and a seal ring 92. Seal rings 88 seal against leakage between the piston heads 64 and the inner surface of cylinder body sidewall 42. Seal ring 92 seals against leakage between the cylinder head 48 and the outer surface of the piston rod 62.

According to an aspect of the invention, piston rod 62 includes radial sidewall ports P1, P2, P3, P4, P5, P6, P7. These ports P1, P2, P3, P4, P5, P5, P7 are spaced around piston rod 62 along a helical path. This path is shown straightened out in FIG. 6. The object of this arrangement of the ports P1, P2, P3, P4, P5, P6, P7 is to axially space apart the ports P1, P2, P3, P4, P5, P6, P7 in a relatively short axial distance.

Figure 5:
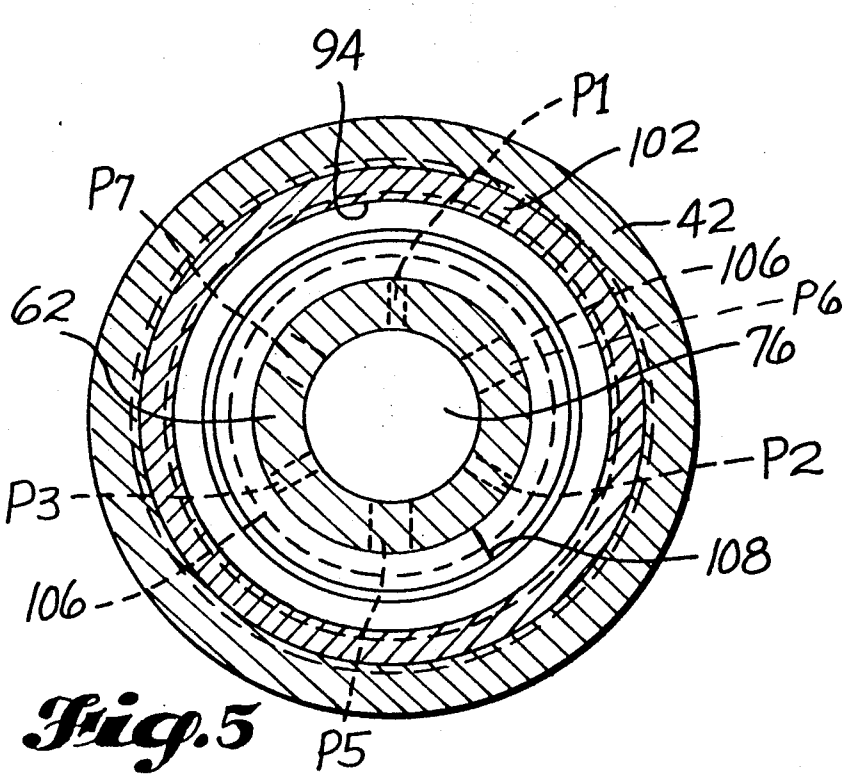
FIG. 5 is a sectional view taken substantially along line 5—5 of FIG. 3.
Figure 4:
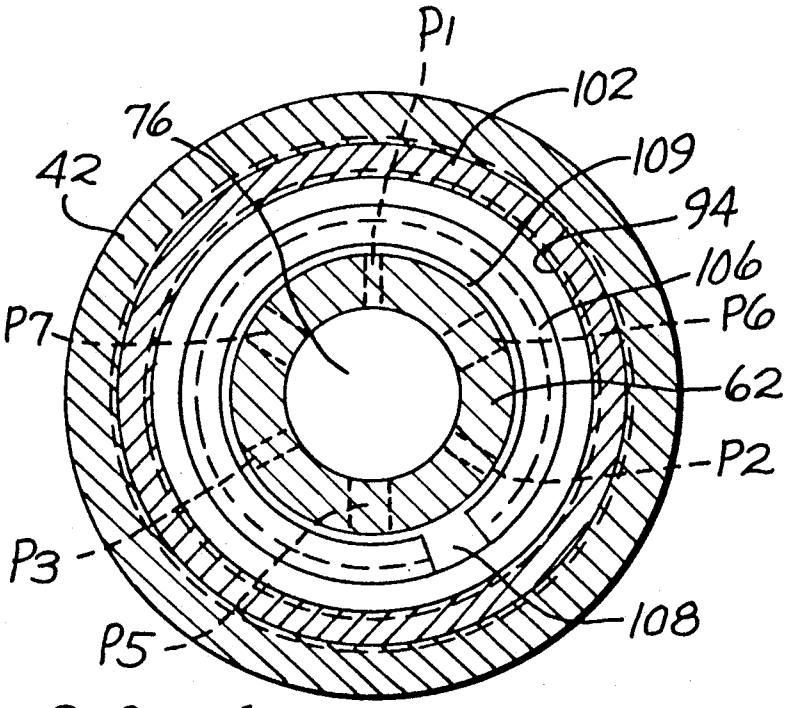
FIG. 4 is a sectional view taken substantially along line 4—4 of FIG. 2.

Cylinder head 48 includes an inside annular groove 94 and an outside annular groove 96. This forms a cylindrical wall 98 that is threaded at its outer surface. The threads mate with the threads 100 on the inner surface of a cylindrical sidewall 102 that is a part of a retainer ring. This retainer ring includes a radial flange 104. When the ring 102, 104 is attached to wall 98, flange 104 forms a partial end closure for the channel 94. An annular valve ring 106 is located within this chamber. Valve ring 106 is a one-piece member but it includes an axial split 108 (FIGS. 4 and 5). The static condition of valve ring 106 is as shown in FIG. 5. The ends of the split 108 are essentially together and the inner cylindrical surface of valve ring 106 snugly engages the outer surface of piston rod 62.

As shown in FIGS. 2, 3 and 7, a radial gap 110 exists between the outer surface of piston rod 62 and the cylindrical inner surface of flange 104.

Referring to FIG. 2, the introduction of pressure P into port 78 while port 74 is connected to return will cause passageway 80 to fill up with the pressure fluid. This pressure fluid will move radially outwardly through the ports P1, P2, P3, P4, P5, P6, P7 and exert a radially outwardly directed force on valve ring 106. This will cause valve ring 106 to expand into the position shown by FIG. 2. The radial dimension of the channel 94 is larger than the radial dimension of valve ring 106. As a result, valve ring 106 can expand in diameter. When this happens, gap 108 opens (FIG. 4). Also, an annular space or passageway 109 is formed between the inner surface of valve ring 106 and the outer surface of piston rod 62 (FIGS. 2 and 4). The pressure fluid moves through the ports P1, P2, P3, P4, P5, P6, P7 and then to and through gap 110 and into working chamber 84. Since port 74 is connected to return, working chamber 82 is also connected to return, via passageway 76. As a result, working chamber 84 will expand and working chamber 82 will contract. As this happens, the valve ring 106 is moved axially relatively away from the ports P1, P2, P3, P4, P5, P6, P7 (FIG. 7). Throughout about one half of the movement of the cylinder body 38 relative to the piston component 40, the ports P1, P2, P3, P4, P5, P6, P7 are unobstructed by the valve ring 106.

Figure 6:
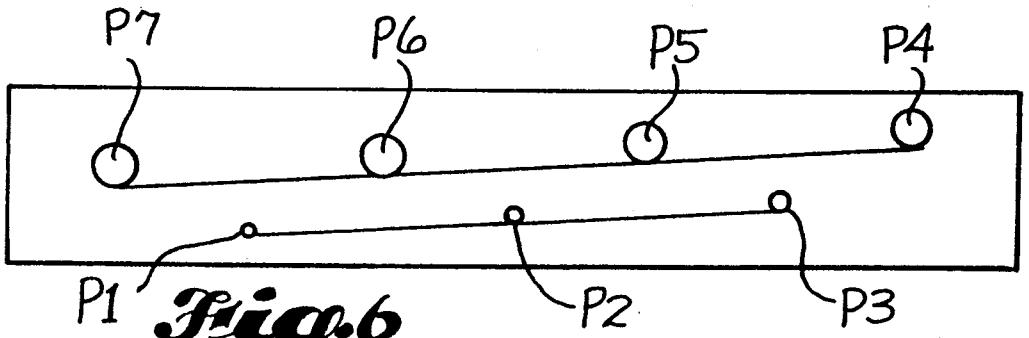
FIG. 6 is a flat diagram of the hole pattern in the sidewall of the piston rod.

When valve ring 106 is in the position shown by FIG. 3, it closes the ports P1, P2, P3, P4, P5, P6, P7. However, it will readily open in response to the introduction of pressure into port 78. Referring to FIG. 7, when pressure and return are reversed between ports 74, 78, i.e. when port 74 is connected to pressure and port 78 is connected to return, the sidewall ports P1, P2, P3, P4, P5, P6, P7 are unobstructed. Pressure introduction into working chamber 82 via passageway 76, while working chamber 84 is connected to return, will cause an extension of the cylinder body 38 relative to the stationary piston component 40. Fluid flow from working chamber 82 is first through the ports P1, P2, P3, P4, P5, P6, P7 and then into annular passageway 80 and from annular passageway 80 out from port 78 to return. As will be appreciated from studying FIGS. 2, 3, and 7, movement of cylinder head 48 relatively towards piston head 64 will move valve ring 106 first over port P7, then over P6, then over port P5, then over port P4, then over port P3, then over port P2, and finally over port P1. The helical pattern of the ports places the ports in close axial spacing. Preferably, at least the last three ports P3, P2, P1 decrease in size. This is illustrated in FIG. 6. Thus, as cylinder head 48 moves axially away from piston head 64, the valve ring 106 functions to successively close the ports, starting with port P7 and ending with port P1. As each successive port is closed, the ability of hydraulic oil to escape from working chamber 84 is reduced. It is further reduced by the size reduction of the last several ports. As shown in FIG. 3, when port P1 is finally closed, there is still some oil trapped in working chamber 84. This trapped oil prevents metal-to-metal contact between piston head 64 and flange 104 which is a part of the cylinder head 48. Accordingly, the valve ring 106 and the pattern of ports P1, P2, P3, P4, P5, P6, P7 together form a gradual shut off of oil escape from working chamber 84 which acts to slow down the movement of cylinder body 38 relative to piston component 40 at the end of the retraction stroke. The capture of oil in chamber 84 provides a buffer or cushion at the end of the retraction stroke so that the two metal parts 64, 104 do not strike each other, causing both wear and an objectionable end of stroke noise.

The illustrated embodiment is an example of the invention. The scope of protection is not to be determined by the illustrated embodiment but rather by the claims which follow, construed by use of the established rules of patent claim construction, including use of the doctrine of equivalents and reversal of parts.

What is claimed is:

1. A linear hydraulic motor, comprising:

a piston-cylinder unit having a cylinder body reciprocally slidable on a piston rod, said piston rod having a piston head defining a working chamber within the cylinder body, and said piston rod being tubular and having a plurality of sidewall ports;

a radially expandable annular valve ring normally snugly surrounding the piston rod, wherein during axial movement of the cylinder body relative to the piston rod, the valve ring will move axially relative to the sidewall ports in the piston rod;

wherein pressure introduction to said working chamber through the tubular piston rod causes oil to flow through the sidewall ports of the piston rod and against the valve ring, to radially expand the valve ring, and allow the oil flow to move into the working chamber such that when said chamber expands, said cylinder body and said valve ring will move axially relative to the sidewall ports, successively uncovering the ports during movement; and wherein removal of fluid from said working chamber will cause oil movement out from the chamber, through the sidewall ports into the tubular piston rod such that when the linear motor approaches the end of its stroke the valve ring will close in succession the sidewall ports in the piston rod which allow oil flow out from the working chamber.

2. The linear hydraulic motor of claim 1, wherein the sidewall ports are positioned such that a last port is closed and further oil flow out from the working chamber is prohibited before there is contact between the piston head and a cylinder head portion.

3. A linear hydraulic motor, comprising:

a cylinder body having a cylindrical sidewall, a closed end and an open end;

a cylinder head in the open end, said cylinder head including a central passageway and an annular valve ring chamber surrounding said passageway;

a piston component having a piston rod which extends through said passageway and a piston head that is positioned axially between the cylinder head and the closed end of the cylinder body, with a first working chamber being defined axially between the piston head and the closed end of the cylinder body, and a second working chamber being formed axially between the piston head and the cylinder head;

said piston rod being tubular;

a center tube located within the piston rod, said center tube providing a fluid passageway through its center which communicates with the first working chamber, and an annular second passageway being formed by and radially between the piston rod and the center tube;

said piston rod having a plurality of sidewall ports;

a valve ring in the valve ring chamber, said valve ring being annular and including an axial split, said valve ring normally snugly surrounding the piston rod, and said valve ring chamber having a radial dimension permitting radial expansion of the valve ring; and wherein during axial movement of the cylinder body relative to the piston component, the valve ring will move axially relative to the sidewall ports in the piston rod;

wherein pressure introduction into the annular chamber while the center tube is connected to return will cause oil to flow out from the first working chamber through the center tube and oil to flow through the sidewall ports of the piston rod and against the valve ring, to expand the valve ring, and allow the oil flow to move into the second working chamber, causing expansion of the second working chamber and contraction of the first working chamber; and wherein pressure introduction into the center tube while the annular chamber is connected to return will cause oil movement out from the second working chamber, through the sidewall ports into the annular chamber, and oil introduction into the first working chamber, attended by an increase in volume in the first working chamber and a decrease in volume of the second working chamber; and wherein when the linear motor approaches the end of its stoke the valve ring will close in succession the sidewall ports in the piston rod which allow oil flow out from the second working chamber; and wherein the last sidewall port is positioned such that it is closed and further oil flow out from the second working chamber is prohibited before there is contact between the piston head and the cylinder head.

* * * * *